United States Patent [19]

O'Rourke et al.

[11] 4,270,476

[45] Jun. 2, 1981

[54] BARGE CONSTRUCTION FOR WARM AIR CANOPY ICE-FREE ZONE

[75] Inventors: J. Cam O'Rourke; G. Roger Pilkington, both of Calgary; Frank G. Bercha, Cochrane, all of Canada

[73] Assignee: Dome Petroleum Limited, Canada

[21] Appl. No.: 54,661

[22] Filed: Jul. 5, 1979

[51] Int. Cl.[3] ..... B63B 35/08

[52] U.S. Cl. ..... 114/40

[58] Field of Search ..... 114/40, 41, 42, 67 A, 114/68, 69, 270; 9/6 P

[56] References Cited

U.S. PATENT DOCUMENTS

| | | | |
|---|---|---|---|
| 3,139,635 | 7/1964 | Daffer | 9/6 P |
| 3,749,162 | 7/1973 | Anders | 114/40 |
| 3,929,083 | 12/1975 | Blankenship et al. | 114/40 |
| 3,972,199 | 8/1976 | Hudson et al. | 114/40 |

*Primary Examiner*—Trygve M. Blix
*Assistant Examiner*—Jesus D. Sotelo
*Attorney, Agent, or Firm*—Lerner, David, Littenberg & Samuel

[57] ABSTRACT

A novel barge construction is disclosed herein for providing a substantially ice-free zone around a vessel out to at least 100 feet from the vessel. The barge comprises: (a) a hull including a bow, a stern and, a pair of sides, a flat bottom all covered by plating and a deck covered by decking; (b) a hull stabilization system including a lattice framework filled with solid insulation material; (c) a liquid/gas heat exchange system within the hull, such heat exchange system having ducts and outlets therefrom from the hull to project hot gas towards the surface of the water and recirculation inflow structure to recover air and hot gas from the region of the surface of the water; (d) a cantilevered section extending forwardly from the bow and including longitudinally extending skirt ducts therein connected to the heat exchange system ducts and outlets; and (e) a skirt suspended from the forward edge of the cantilevered section to below the waterline of the barge. The skirt comprises an outside depending portion to project below the surface of the water and a shorter inside depending portion to terminate above the surface of the water, to define a hot gas chamber therebetween, the hot gas chamber being connected to the skirt ducts. The barge distributes warm air in a manner and quantity sufficient substantially to prevent ice formation under the barge hulls and under the cantilevered sections.

12 Claims, 9 Drawing Figures

BARGE CONSTRUCTION FOR WARM AIR CANOPY ICE-FREE ZONE

BACKGROUND OF THE INVENTION (i) Field of the Invention

This invention relates to improvements in the drilling of oil and gas wells in polar regions. More particularly, it relates to improved techniques for effectuating such drilling in the wintertime in the Arctic Ocean and more especially in the Beaufort Sea area of the Arctic, although it is feasible for application in other areas where similar conditions exist. Still more particularly, it relates to a novel floating structure which is used to provide a method and apparatus for providing an ice-free zone around a drillship to enable such wintertime drilling.

(ii) Description of the Prior Art

At the present time drilling in offshore Arctic regions is carried out in the summertime either by the use of drillships anchored at a drill site where the risk of impingement by ice floes is minimal, or through the use of artificial islands. Summertime drilling is feasible for depths from 60 feet to 200 feet or more. Artificial islands currently being used in the shallow water regions of the Beaufort Sea become excessively expensive in water depths of 40 feet or greater. It appears uneconomical at the present time to build artificial islands for exploratory drilling wells in water depths exceeding 40 feet. It may be economical to drill production wells from artificial platforms in water depths exceeding 40 feet. Moreover, it is presently not feasible to drill exploratory wells from floating ice islands in the regions where ice movement is too great (i.e., more than a few feet).

One of the chief obstacles to overcome in drilling in Arctic regions is the Arctic pack ice. The ice grows to a thickness of approximately 6 feet and is laced with pressure ridges and ice islands which can reach thicknesses of over 100 feet. The pack ice moves at speeds from 0 to 20 or more miles per day with an average movement of approximately 2 miles per day.

If drilling were to take place in waters where there was considerable ice movement, a very solid structure would be required in order to withstand the forces exerted upon it by the ice pack and yet to be able to remain on position in order to drill a well. For exploratory drilling operations, a solid bottom founded structure should be provided which could resist the movement of the ice pack and yet would be mobile enough to be transported from one exploratory drilling site to another.

Drilling with structures on the sea bottom has numerous problems. Firstly, there is the problem of designing hulls which could withstand the ice forces from deep ice keels against these structures. In the second place, subsea systems would have problems of buoyancy, life-support systems, power supply, and access for cress and maintenance.

It would, therefore, be desirable to develop another technique that would allow exploratory drilling during winter months. Such system should also be able to extend operational capability into the shorefast ice. This technique has the potential for drilling wells more economically than any other method in the shorefast ice regions. Using this technique, the rate of exploration in the Beaufort Sea would be increased by a factor of from two to four times. This technology of using drillships in shorefast ice could be applied to other regions of the Canadian Arctic. The techniques used for drilling in shorefast ice are a logical step toward developing year-round drilling systems in pack ice regions.

The development of such technology is important since the risks to the environment of a drilling system in the shorefast ice are relatively low. One advantage of operating in shorefast ice is that the ice moves very little throughout the winter. Any oil spilled underneath the ice would be confined to a very small area where it could be removed from the environment.

SUMMARY OF THE INVENTION (i) Aims of the Invention

The initial problem which the present invention proposes to overcome is the provision of a floating system which can be used to maintain a substantially ice-free area around the drillship out to at least 100 feet from such drillship, and in particular, such an ice-free area around a drillship operating in shorefast ice zones during winter.

Accordingly, it is an object of the present invention to provide a barge which is used for maintaining an ice-free area around a ship out to at least 100 feet from the vessel.

Another object of the present invention is to provide a barge which is used for maintaining an ice-free zone around a drillship out to at least 100 feet from the drillship using a forced air heating system to distribute air heated by a liquid/gas heat exchange system, in a manner and quantity sufficient substantially to prevent any appreciable ice formation under the barge hulls and under the cantilevered sections.

A further object of the present invention is to provide a barge which is simple to construct, has a good weight/strength ratio and may be easily deployed.

(ii) State of Invention

By this invention, a barge is provided comprising: (a) a hull including a bow, a stern, a pair of sides, and a flat bottom, preferably covered by plating, and a deck, preferably covered by decking, the hull including a hull stabilization system which includes a lattice framework filled with solid insulation material; (b) a cantilevered section extending forwardly from the bow and including longitudinally extending ducts means, the cantilevered section also including a skirt depending from the forward edge of the cantilevered section to below the waterline of the barge, the skirt comprising an outside depending portion to project below the surface of the water and a shorter inside depending portion to terminate above the surface of the water, to define a hot gas chamber therebetween, said hot gas chamber being connected to the longitudinally extending duct means; and (c) a liquid/gas heat exchange system located within the hull for heating gas with liquid and projecting the gas into the longitudinally extending duct means, so that hot gas is projected toward the surface of the water through the hot gas chamber and the formation of ice is prevented thereby.

(iii) Other Features of the Invention

By one feature of the barge of this invention, the hull includes outlet means as well as hull duct means for conducting the hot gas from the liquid/gas heat exchanger system to the longitudinally extending duct means in the cantilevered section and to the outlet means whereby hot gas is projected from the hull to the space formed within the cantilevered section.

By another feature of the barge of this invention, the hull includes recirculation inflow means for recovering air and hot gas from the region of the surface of the water.

By one feature of the barge of this invention, the framework is formed of aluminum tubing.

By another feature of the barge of this invention, the solid insulation is reinforced foamed poylurethane.

By a further feature of the barge of this invention, the plating and the decking are of steel.

By a still further feature of the barge of this invention, the plating is of plywood and the decking is of steel.

By yet another feature of the barge of this invention, the ducts are light plastic or reinforced paper embedded in rigid foamed-in-situ polyurethane.

By another feature of the barge of this invention, the barge includes a coating of an ice phobic material on the central bottom surface of the hull.

By a still further feature of the barge of this invention, the skirt comprises inner and outer flexible fabric sheets forming therebetween the aforesaid hot gas chamber.

BRIEF DESCRIPTION OF THE DRAWINGS

In the accompanying drawings.

Figure 1:
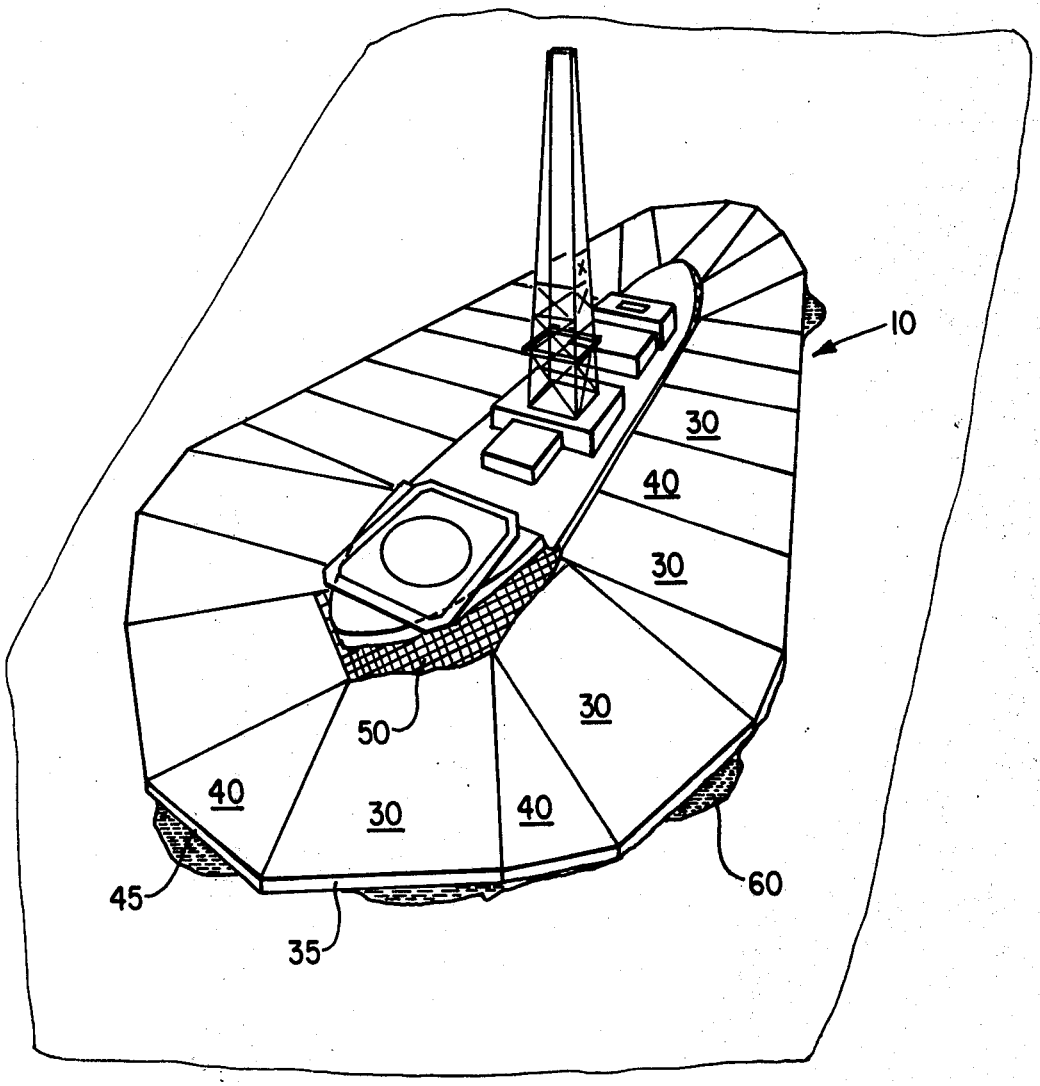
FIG. 1 is a perspective view of a barge of a feature of this invention in its preferred environment of use.

DETAILED DESCRIPTION OF EMBODIMENTS OF THE INVENTION (i) Description of FIG. 1

Referring now to FIG. 1, a drillship 10 is shown, the drillship being generally of the type used in offshore drilling operations and particularly in Arctic zones. When operating in this environment, there is a severe hazard associated with the effect of ice encroaching on the drillship itself. In order to counteract the effect of ice encroaching on the drillship, barges of a feature of this invention are deployed about the perimeter of the drillship, as shown in FIG. 1.

As seen in FIG. 1, the canopy system (disclosed and claimed in copending U.S. application Ser. No. 054,997 filed July 5, 1979 (the relevant portions of which are incorporated herein by reference) of which the barge of a feature of this invention is an essential part, includes floating modules 30 and roof modules 40, as well as membrane 50 which covers the non-linear areas in close proximity with the drillship 10 and within the periphery of the canopy system not covered by floating modules 30 and roof modules 40. Floating modules 30 and roof modules 40 are provided with the flexible downwardly depending skirts 35 and 45, respectively, which extend downwardly from the outer edge of floating module 30 and roof module 40 to slightly below the water surface 60.

Figure 2:
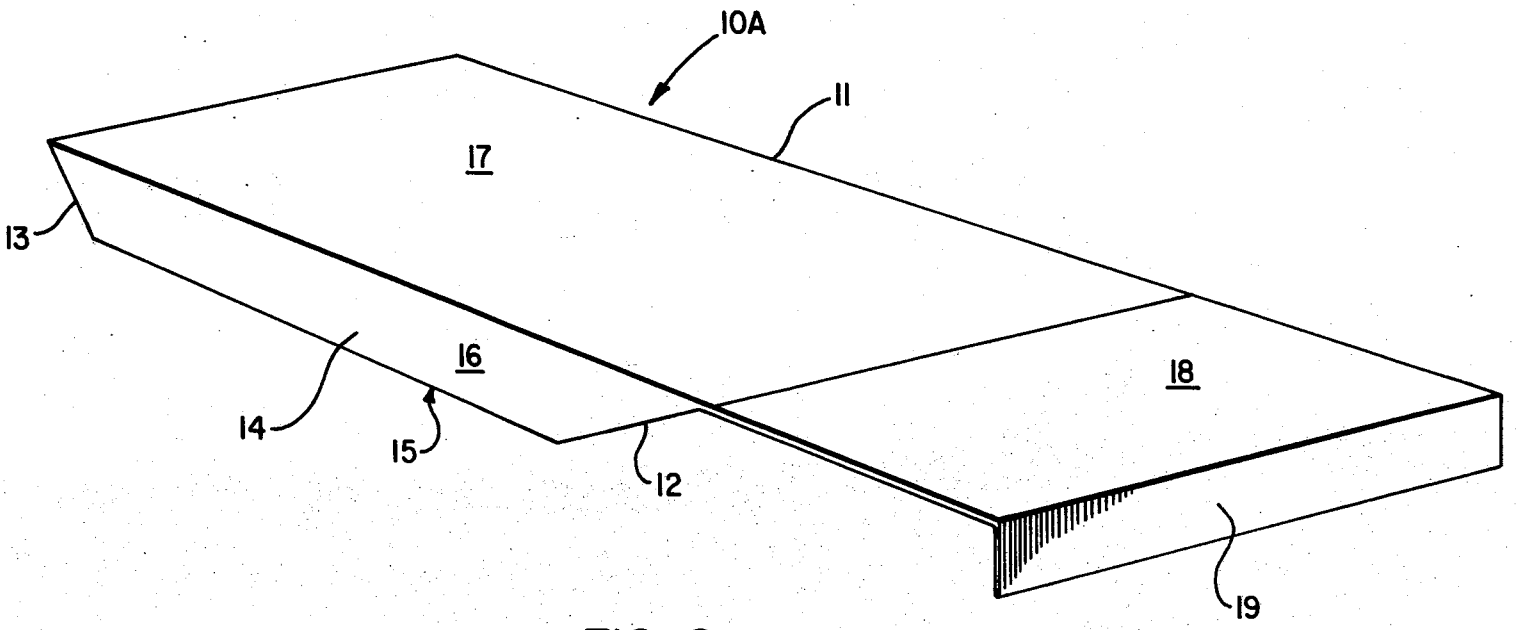
FIG. 2 is a perspective view of the barge of a feature of this invention.

(ii) Description of FIG. 2

As seen in FIG. 2, the barge 10A includes a hull 11 having a gently raked bow 12, a highly raked stern 13 and a pair of inwardly sloping side walls 14 and a bottom 15. A plating 16 surrounds the hull 11 and the top is covered by decking 17. A cantilevered section 18 projects beyond the decking 17 at the bow 12, and cantilevered section 18 is provided with a depending skirt 19. The barge hull 11 is thus shaped to ride up on ice sheet, and the leading edge of the barge hull is provided with a flexible skirt (to be described in detail hereinafter) which permits ice movement underneath while sealing the heat within the system. A forced air heating system (also to be described hereinafter) is integrated into the barge hull to distribute air heated by the drillship waste heat, in a manner and quantity sufficient to prevent any significant ice formation under the barge hull.

The construction of the barge 10A is such that the hull 11 and frames are flexible enough to absorb impact and to accommodate differential support movement. As noted above, the barge 10A is supplied with simple forced air heating systems (also to be more fully described hereinafter) which are adaptable to multiple conditions.

The cantilevered section 18 provides a perimeter overhang to negotiate 95% of anticipated ice movement. Forced air heating of the cantilevered section 18 is also provided, and this section 18 is sealed by the skirt 19. The structure of the skirt to prevent freezing will be described hereinafter.

The barge 10A has an inclined plane, smooth slide skin to facilitate ride-up onto ice in any direction, regardless of discontinuities in the ice sheet. The barge 10A is provided with a large continuous surface with rounded corners to prevent hang-up in ice sheet discontinuities. An ice phobic coating, well known to those skilled in the art, is provided on the central bottom surface 15 (see FIGS. 5–8) of the hull 11 where ice scour will be low, but where the adfreeze force could be high.

The barge 10A is provided with floatation material inside the hull 11 to provide failsafe floatation. In addition, shipside collapsible bulkheads or flexible bumpers are provided to minimize forces from ice interactions. There is overall flexibility of the hull 11, deck 17 and frame to minimize load transfer to the drillship. Also, rigid deck panels 17 are provided to permit operation of snow removal equipment and maintenance crews.

The hull 11 of the barge 10A is formed of chemically fused panels or welded steel plate. Suitable materials include, for example, steel, ferroconcrete, FIBERGLAS (the Trade Mark for glass fibers) and LEXAN (the Trade Mark for a polycarbonate resin of General Electric Co.). In a preferred embodiment of the present invention, LEXAN panels are chemically fused at the construction site. LEXAN is relatively inexpensive and possesses low adfreeze properties.

In order to stabilize the hull 11, a conventional steel or aluminum framing system may be located inside and attached to the hull skin. In a preferred embodiment of the present invention, however, stability is provided for the hull through the in situ blowing of a rigid-setting urethane foam. All heating system ductwork, bulkheads, cantilever frame attachments and other items are installed in the hull and are embedded in the rigid-setting foam. The ducts are preferably made of reinforced paper or of light plastic. Use of the foam system has the advantage over the full framing system of requiring very little labour during construction, providing good hull insulation, providing a flexible, virtually indestructible hull stabilizer, and serving as a failsafe back-up for possible hull failure.

The barge system is provided with a heating system which employs heat collected from the drillship. In one embodiment, all the engines on the drillship send jacket and exhaust heat into common glycol/water headers. The hot glycol/water is distributed by pipes to headers along the perimeter of the drillship. The hot glycol/water is pumped to heat exchangers which are positioned in the barges, and which include single stage axial fan units which would extract heat from the glycol/water solution, recirculate the air in the barge and canopy, and mix in fresh air as required due to infiltration losses.

(iii) Description of FIGS. 3 to 9 inclusive

Figure 3:
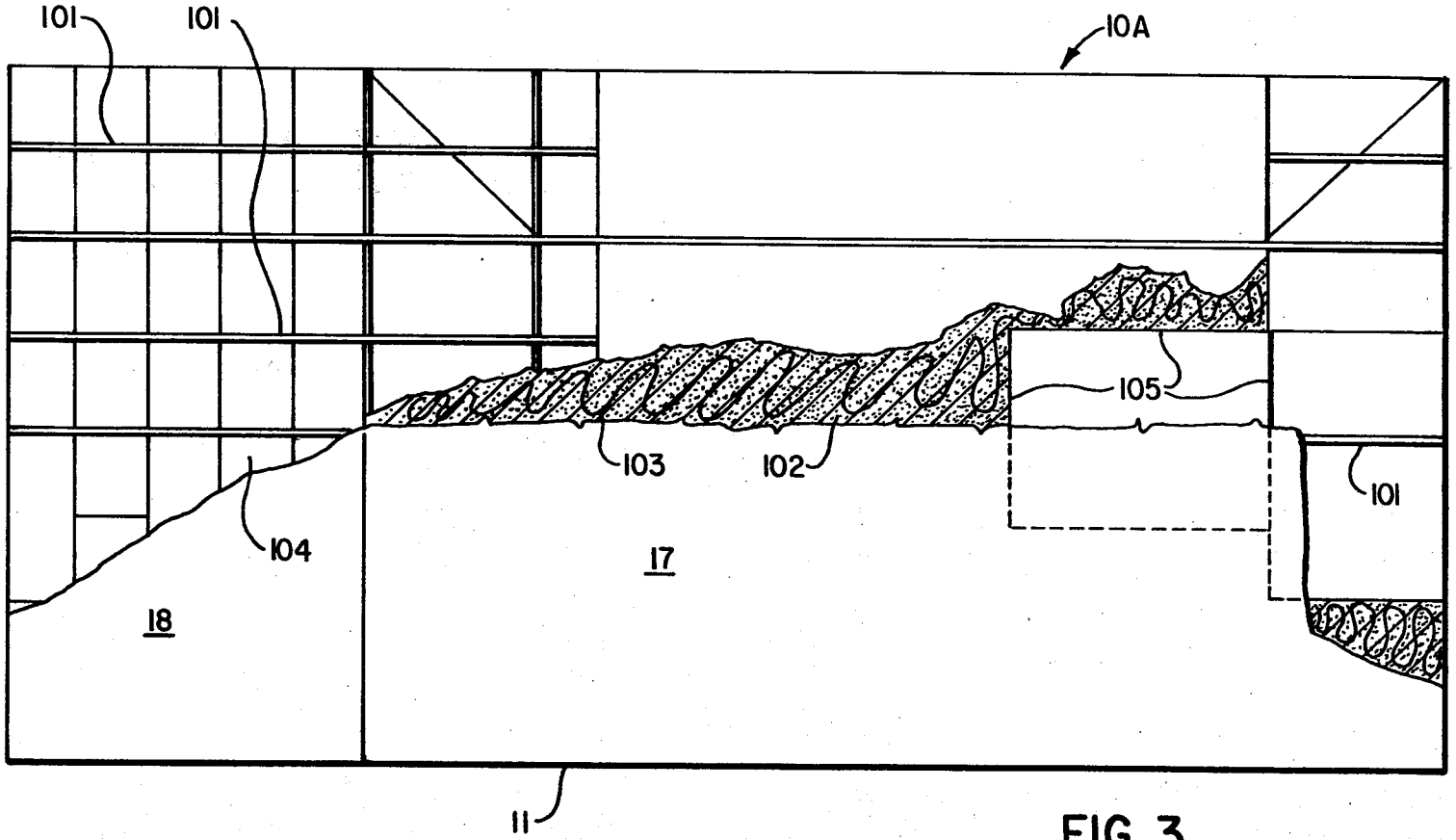
FIG. 3 is a top plan view of the barge, with a portion of its top decking removed for clarity and showing some structural aspects.
Figure 5:
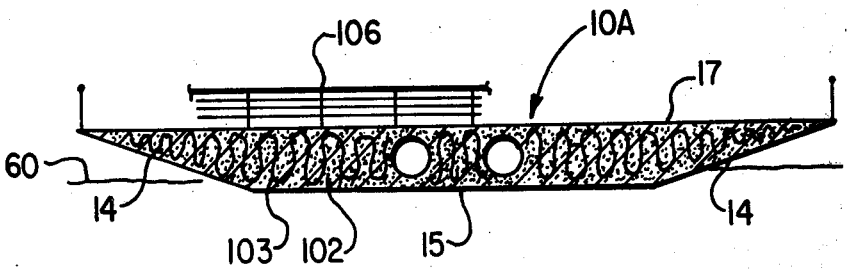
FIG. 5 is a transverse section along the line V—V of FIG. 4.
Figure 7:
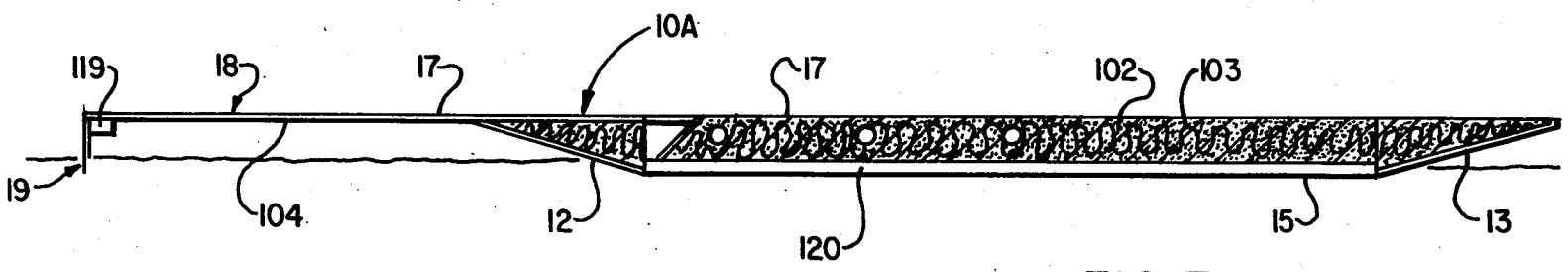
FIG. 7 is a longitudinal section along the line VII—VII of FIG. 4.

Now referring to FIGS. 3, 5 and 7, which show essentially the structural details, the barge 10A is shown to include a metallic lattice-work frame 101 covered by decking 17 (e.g. 16 gauge steel decking). Within the main part of the hull 11 is a rigid urethane foam insulation 102 and a stiffening 103. The cantilevered portion 18 is preferably formed of a urethane foam plywood sandwich 104, which is covered by 16 gauge steel decking 17. Also seen in FIG. 3 is a 10 gauge steel bulk head 105. A railing 106 is provided along the edge of the barge 10A for protection purposes.

Figure 4:
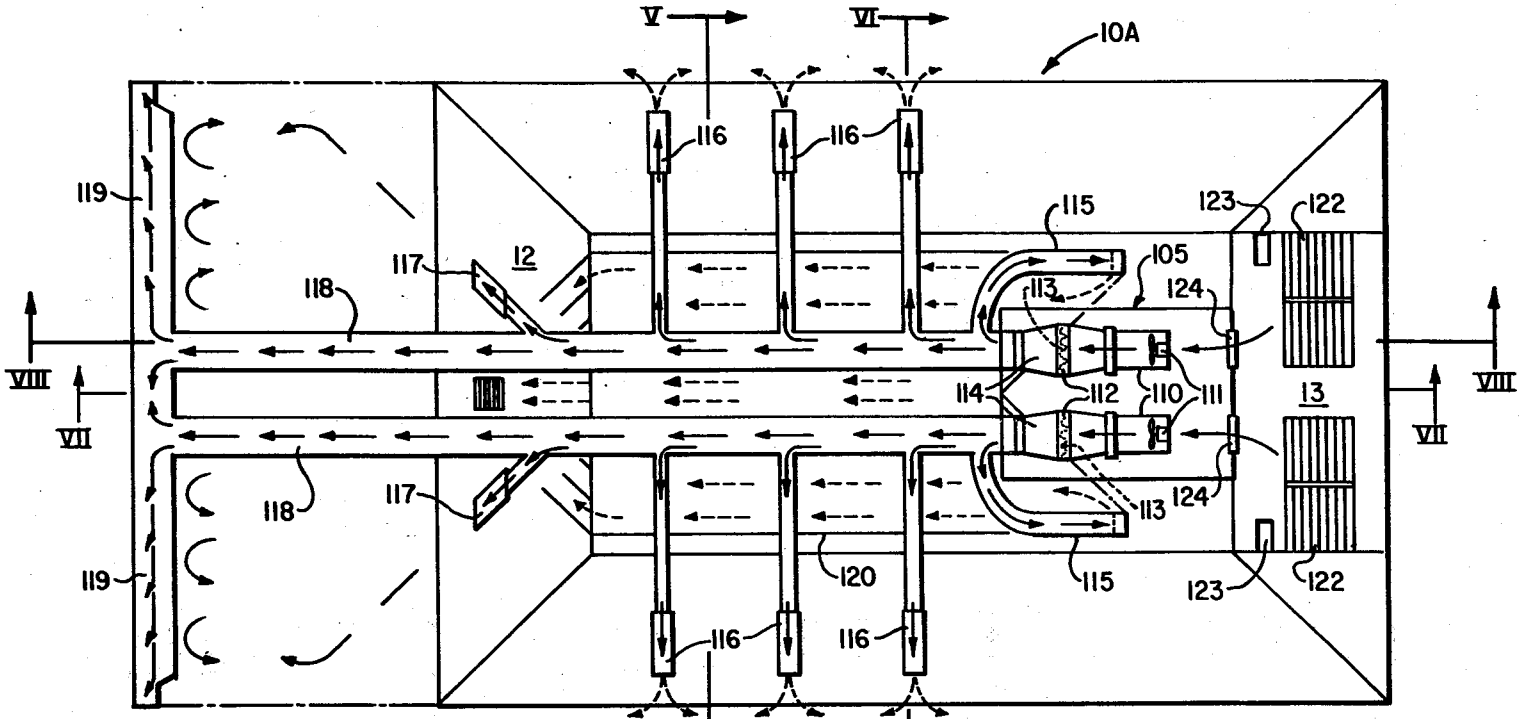
FIG. 4 is a central horizontal section through the barge of one embodiment of this invention and showing heating duct aspects.
Figure 6:
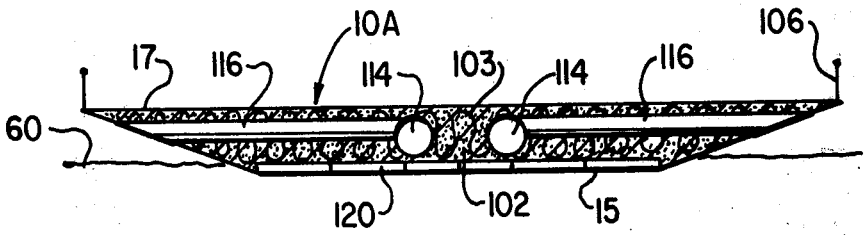
FIG. 6 is a transverse section along the line VI—VI of FIG. 4.
Figure 8:
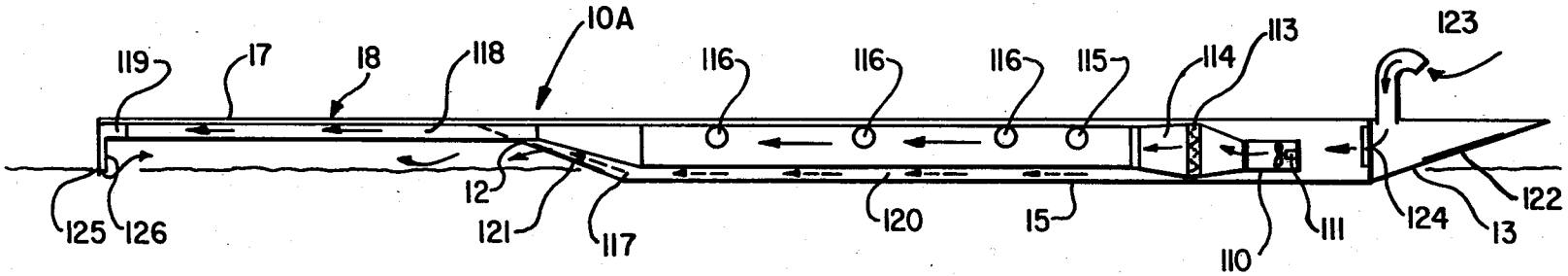
FIG. 8 is a longitudinal section along the line VIII—VIII of FIG. 4.

As seen in FIGS. 4, 6 and 8, which show essentially the heating duct details, the barge 10A includes a system of hot air circulation conduits provided in the port and starboard sides thereof. The interior of the bulkhead 105 provides a fan chamber having an air intake register 124 leading to two air intake conduits 110, each provided with a circulation fan 111. Conduits 110 lead via flexible joints 112 to liquid/gas heat exchanger coils 113. Coils 113 provide hot air to outlet ducts 114 which lead to a plurality of ducts, namely ducts 115 leading astern, ducts 116 leading port and starboard, and duct 117 leading through the bow. In addition, skirt ducts 118 lead under the cantilevered portion 18, skirt ducts 118 then leading as skirt bleeder ducts 119 parallel to the skirt 19. Along the flat keel of the barge 10A is a hull plenum 120 discharging at a central bow discharge 121.

The heating system is provided with rectangular recirculation openings 122 disposed in the stern 13. In addition, the fan chamber is provided with fresh air intakes 123.

As also seen in FIG. 8, the structure of the skirt includes an outer flexible lip 125 separated from a flexible inner layer 126. Full details of this skirt are disclosed and claimed in copending U.S. application Ser. No. 054,998 filed July 5, 1979 (the relevant contents of which are incorporated herein by reference).

Figure 9:
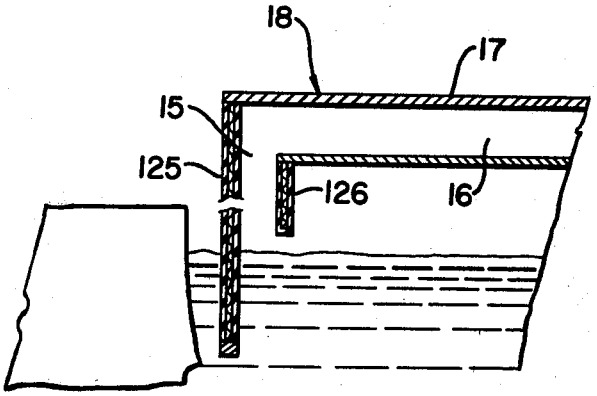
FIG. 9 is an enlarged side view of the skirt of FIG. 8.

The specific structure of such skirt, as described in the above-identified U.S. application Ser. No. 054,998 and as shown in FIGS. 8 and 9 hereof, provides a skirt system including a double flexible skirt which is constituted by an outside skirt portion 125 and an inside skirt portion 126. The combination of outside skirt portion and inside skirt portion are suspended in the warm water/ice zone which has been created by the use of hot gas compartments at the interface to the outside cold air. The outside skirt portion is of a length sufficient to be suspended below the water surface and is slightly longer than the inside skirt portion.

The outside skirt portion preferably includes a thicker steel lip thereon at the water surface to hold the lower edge of the skirt below the water surface. Such lip is preferably provided with an ice phobic coating (known ot those skilled in the art) intended to prevent ice formation on the cold side of the skirt. The common length portions of the outside skirt and inside skirt are made of a suitable fabric, e.g., a rubber coated synthetic fiber fabric, for example, a 60 oz. natural rubber/nylon fabric or its equivalent. The passage between the outside skirt and the inside skirt is connected via appropriate ducts to the source of hot gas on the barge 10 as described in the present application. Means, previously described herein, are provided for circulating hot gas within the passage. Since the outside skirt portion is slightly longer than the inside skirt portion and since it descends below the surface of the water, the hot gas which is pumped through the passage is thereby permitted to return to the area below cantilevered portion 18 of the barge 10 (as described hereinbefore).

DESCRIPTION OF OTHER EMBODIMENTS OF THE INVENTION

The barge 10A of this invention is preferably provided by a framework plated with a material having anti-adfreeze properties, filled by in situ blowing of a rigid-setting urethane foam which embeds the heating system ductwork, bulkheads, and cantilever frame attachments. Use of this foam has the advantage of requiring very little labour, providing a flexible virtually indestructible hull stabilizer and serving as a failsafe back-up for possible hull failure.

In order to protect the surface of the deck from abrasion due to snow clearing, sixteen gauge steel sheets may, for example, be used as cover for the panels. In a preferred embodiment of the present invention, namely, when the urethane foam stabilizer is applied in situ, the steel sheets may be applied directly to the urethane foam stabilizer. The skirt system provides a seal about the perimeter of the barge system, while permitting ice movement beneath it.

Construction of the major components of the barge can be carried out either in the North or in a temporary shelter in a sourthern port facility. All frames, panels, decking, heating system components and other main items will be fabricated in specialized suppliers' plants. The components will then be shipped to a temporary assembly site where precut hull plates can be welded or fused, frames bolted, the internal components installed, and urethane foam added. Alternatively, the assembly could be carried out in a different location, with the completed modules shipped by barge. From the assembly base, the barge modules can be shipped to the site on a spreader system to distribute the support forces on the modules.

Once deployed, the barge system operates virtually automatically. The barge system will be thermostatically controlled for optimal heat distribution. Snow clearing and temperature and ice movement monitoring should be the only operating functions apart from regular inspections and maintenance required for barge system operation.

CONCLUSION

This invention provides a feasible floating structural system utilizing drillship waste heat to maintain an ice-free area around the drillship has been identified and developed. This is a highly innovative concept which takes advantage of contemporary aerospace materials. Use of LEXAN for hull construction is new. The concept of using a rigid-setting foam to simultaneously stabilize the hull, insulate against the environment, and provide embedment for mechanical systems is a new idea in naval technology.

Consequently, it is noted from the foregoing description that one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

We claim:

1. A barge comprising:

(a) a hull including a bow, a stern, a pair of sides, a flat bottom and a deck, said hull comprising a hull stabilization system including a lattice framework filled with solid insulation material;

(b) a cantilevered section extending forwardly from said bow and including longitudinally extending duct means, said cantilevered section including a skirt depending from the forward edge of said cantilevered section to below the waterline of said barge, said skirt comprising an outside depending portion to project below the surface of the water and a shorter inside depending portion to terminate above the surface of the water, to define a hot gas chamber therebetween, said hot gas chamber being connected to said longitudinally extending duct means; and (c) a liquid/gas heat exchange system located within said hull for heating said gas with said liquid and projecting said gas into said longitudinally extending duct means, whereby said hot gas is projected towards said surface of said water through said hot gas chamber and the formation of ice is prevented thereby.

2. The barge of claim 1 wherein the lattice framework is formed of aluminum tubing.

3. The barge of claim 1 wherein the solid insulation material is reinforced foamed polyurethane.

4. The barge of claim 1 wherein said hull includes outlet means and hull duct means for conducting said hot gas from said liquid/gas heat exchanger system to said longitudinally extending duct means in said cantilevered section and to said outlet means whereby said hot gas is projected from said hull within said cantilevered section.

5. The barge of claim 4 wherein said hull duct means comprise light plastic embedded in rigid foamed-in-situ polyurethane.

6. The barge of claim 5 wherein said hull duct means comprise reinforced paper embedded in rigid foamed-in-situ polyurethane.

7. The barge of claim 1 including a coating of an ice phobic material on the central bottom surface of the hull.

8. The barge of claim 1 wherein said outside and inside depending portions of said skirt comprise outer and inner flexible sheets.

9. The barge of claim 1 wherein said bow, stern, sides and bottom of said hull are covered by plating, and said deck is covered by decking.

10. The barge of claim 9 wherein the plating and the decking are each of steel.

11. The barge of claim 9 wherein the plating is of plywood and the decking is of steel.

12. The barge of claim 1 wherein said hull includes recirculation inflow means for recovering air and hot gas from the region of the surface of the water.

* * * * *